US005581832A

United States Patent [19]

Bridley

[11] Patent Number: 5,581,832

[45] Date of Patent: Dec. 10, 1996

[54] INFANT SUPPORT

[76] Inventor: Sheryl M. Bridley, R.R. 1 Box 17, Lake City, Minn. 55041

[21] Appl. No.: 158,448

[22] Filed: Nov. 29, 1993

[51] Int. Cl.[6] ..... A47D 13/08; A47D 15/00; A47G 9/00

[52] U.S. Cl. ..... 5/655; 5/922

[58] Field of Search ..... 5/655, 632, 424, 5/425, 630, 465, 922

[56] References Cited

U.S. PATENT DOCUMENTS

| | | | |
|---|---|---|---|
| D. 343,756 | 2/1994 | Sher | 5/655 |
| 3,775,785 | 12/1973 | Mittendorf | 5/640 |
| 4,136,859 | 1/1979 | Hulbert | 5/655 |
| 4,506,396 | 3/1985 | Ritchie, Jr. et al. | 5/631 |
| 4,754,509 | 7/1988 | Pollard | 5/425 |
| 5,165,130 | 11/1992 | Wendling | 5/655 |
| 5,189,748 | 3/1993 | Garrison et al. | 5/655 |
| 5,193,238 | 3/1993 | Clute | 5/655 |
| 5,272,780 | 12/1993 | Clute | 5/655 |
| 5,341,531 | 8/1994 | Straub et al. | 5/655 |
| 5,347,669 | 9/1994 | Neviaser et al. | 5/655 |

*Primary Examiner*—Alexander Grosz

[57] ABSTRACT

In a preferred embodiment, a support for an infant sleeping on one side, said support comprising a base member, a back support releasably attached to said base member, said back support to engage the back of said infant, an abdominal support releasably attached to said base member, said abdominal support to engage the abdomen of said infant, and an adjustment apparatus for selectively positioning apart said back support and said abdominal support so as to accommodate therebetween infants of different sizes.

2 Claims, 3 Drawing Sheets

INFANT SUPPORT

BACKGROUND OF THE INVENTION

1. Field of the Invention

The present invention relates to generally and, more particularly, but not by way of limitation, to infant sleeping supports.

2. Background Art

It has been found that the safest sleeping position for an infant is on its side. Among the reasons for this is that an infant younger than three to four months is unable to lift its head and turn from side to side; therefore, laying the infant on its stomach could restrict the mouth or nose, causing breathing problems. Also, an infant lying on its back has a greater risk of aspirating stomach contents that may be regurgitated.

Some supports for infants and other persons have been developed as follows:

U.S. Pat. No. 4,136,859, issued Jan. 30, 1979, to Hulbert, describes an infant holder which includes a sheet of flexible material elevated above a table surface and having corners thereof attached to spring biased rotatable arms. When an infant is placed on the sheet, the arms rotate over the infant as the infant is lowered to the table surface, arcuately cradling the infant and holding the infant in place. This device is intended for the temporary placement therein of an infant and would not be comfortable for long periods.

U.S. Pat. No. 4,506,396, issued Mar. 26, 1985, to Ritchie, Jr., et al., describes a comfort pillow for pregnant females which includes two, large, symmetrical, spaced apart pillows connected by a thin, smooth intermediate section, the distance between the two pillows being adjustable by means of Velcro strips. A pregnant women lying on her side positions one pillow against her back and the other pillow against her abdomen for comfort. This device would be unsuitable for the support of an infant on its side because of the symmetrical shape of the pillows.

U.S. Pat. No. 5,189,748, issued Mar. 2, 1993, to Garrison et al. describes an infant side support sleeper which includes a base pad having attached thereto waterproof post and pillow casings. A wedge shaped foam or fiber insert is removably inserted in the pillow casing and a vertical oval foam or fiber insert is removably inserted in the post casing. The inserts are removable so that the base pad with the casings attached thereto can be laundered when they become soiled. The pillow and post casings are spaced apart such that an infant lying on its side therebetween will have its back against the pillow and its abdomen against the post. The distance between the pillow and the post is adjustable by means of folding or unfolding tucks in the base pad. However, the distance adjusting means fails to provide positive locking of the pillow and post at a predetermined distance, and the tucks could easily become unfolded in use.

U.S. Pat. No. 5,193,238, issued Mar. 16, 1993, to Clute, describes an infant support pillow which includes two symmetrical, spaced apart supports having facing, straight, parallel, vertical inner surfaces, the distance between the supports being adjustable by overlapping layers of material attached to the lower edges of the supports and having therebetween interlocking Velcro fabric strips. An infant is held between the two supports by means of a strap extending over the infant from one support to the other. The device would clearly be uncomfortable for an infant, as the infant could move its arms only with difficulty and the infant could not assume the normal comfortable fetal position.

SUMMARY OF THE INVENTION

Accordingly, it is a principal object of the present invention to provide an infant support which permits an infant to sleep on its side, but which is comfortable and not constricting.

It is a further object of the invention to provide such an infant support that is positively adjustable to accommodate infants of different sizes.

It is an additional object of the invention to provide such an infant support that is easily and economically constructed.

Other objects of the present invention, as well as particular features, elements, and advantages thereof, will be elucidated in, or be apparent from, the following description and the accompanying drawing figures.

The present invention achieves the above objects, among others, by providing, in a preferred embodiment, a support for an infant sleeping on one side, said support comprising a base member, a back support releasably attached to said base member, said back support to engage the back of said infant, an abdominal support releasably attached to said base member, said abdominal support to engage the abdomen of said infant, and an adjustment means for selectively positioning apart said back support and said abdominal support so as to accommodate therebetween infants of different sizes.

The adjustment means comprises a plurality of spaced apart back support hook and loop fastener strips attached to a lower surface of said back support, a plurality of spaced apart abdomen support hook and loop fastener strips attached to a lower surface of said abdomen support, a first plurality of spaced apart base member hook and loop fastener strips, attached to an upper surface of said base member and corresponding to said plurality of abdomen support hook and loop fastener strips, said abdominal support being releasably attachable to a fixed position on said base member, and a second plurality of spaced apart base member hook and loop fastener strips, attached to an upper surface of said base member and corresponding to said plurality of back support hook and loop fastener strips, said second plurality of spaced apart base member hook and loop fastener strips being substantially longer than said back support hook and loop fastener strips, said back support being positionable at a selected distance from said abdominal support by the mutual engagement of said back support hook and loop fastener strips at a selected position along said base member hook and loop fastener strips.

The plurality of spaced apart back support hook and loop fastener strips are fixedly attached said back support perpendicularly to a longitudinal dimension of said back support. The plurality of spaced apart abdomen support hook and loop fastener strips are fixedly attached to said base member perpendicularly to a longitudinal dimension of said abdomen support.

The first plurality of spaced apart base member hook and loop fastener strips are fixedly attached to said base member perpendicularly to a longitudinal dimension of said base member. The second plurality of spaced apart base member hook and loop fastener strips are fixedly attached to said base member perpendicularly to a longitudinal dimension of said base member.

The abdominal support comprises a substantially flat upper surface, a substantially flat lower surface, said lower surface having a transverse dimension greater than the transverse dimension of the upper surface, a supporting side surface sloping downwardly and inwardly from the upper surface to the lower surface, said supporting side surface for placement adjacent an abdomen of said infant, said supporting side surface further spaced apart from a head of said infant, and an outer side surface disposed substantially vertically, and disposed opposite said supporting side surface.

The back support preferably has a substantially right circular cylindrical form. The abdominal support is about one-half the length of said back support.

The support further comprises a waterproof covering wrapped around said back support and secured in place by means of hook and loop fastener strips, and a waterproof covering wrapped around said back support and secured in place by means of hook and loop fastener strips.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
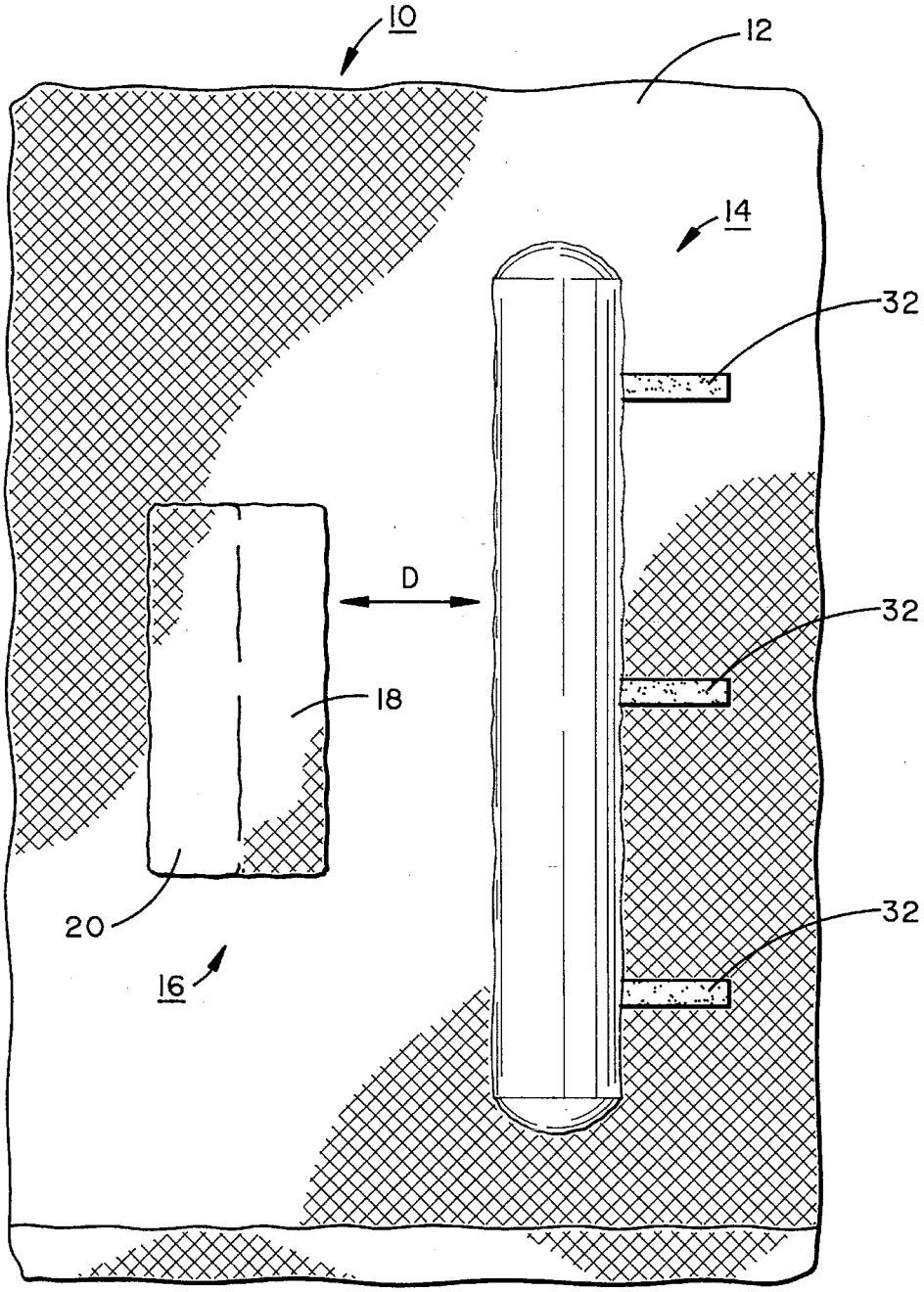
FIG. 1 is a top plan view of an infant support constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Referring first to FIG. 1, there is illustrated an infant support constructed according to the present invention, generally indicated by the reference numeral 10. Infant support 10 includes a quilted base pad 12 having attached thereto a back support, generally indicated by the reference numeral 14, and an abdominal support, generally indicated by the reference numeral 16.

Figure 2:
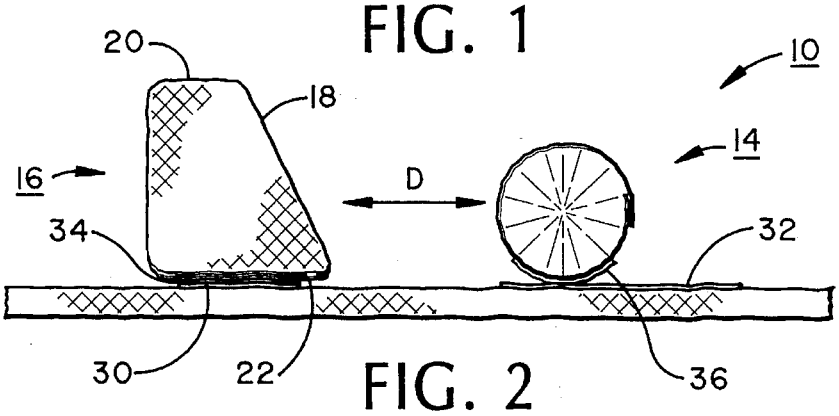
FIG. 2 is an end elevational view of the infant support.

With reference also to FIG. 2, back support 14 has an elongated cylindrical form and abdominal support 16 has an elongated wedge shaped form. The longitudinal axis of the abdominal support is parallel to the back support. The abdominal support is at most one-half the length of the back support. Abdominal support 16 includes an inclined surface 18 sloping inwardly and downwardly from the top 20 to the base 22 thereof.

Figure 3:
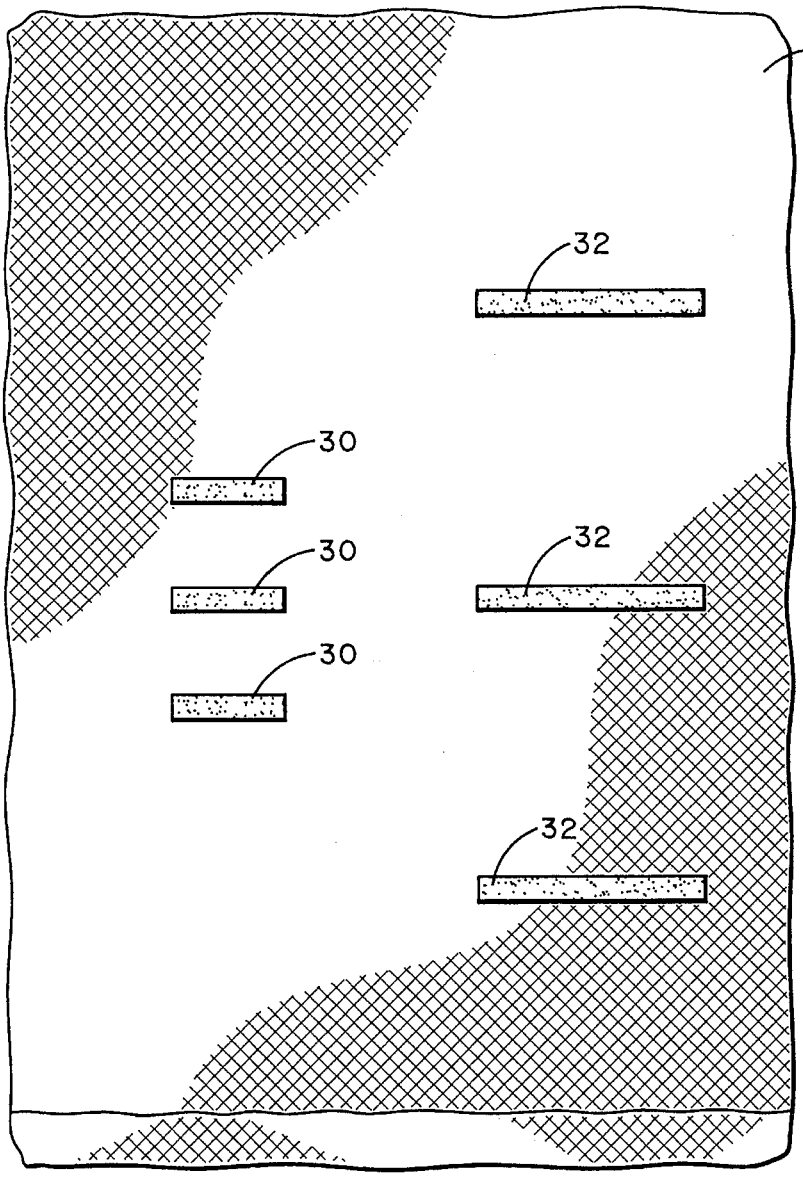
FIG. 3 is a top plan view of the base portion of the infant support.
Figure 4:
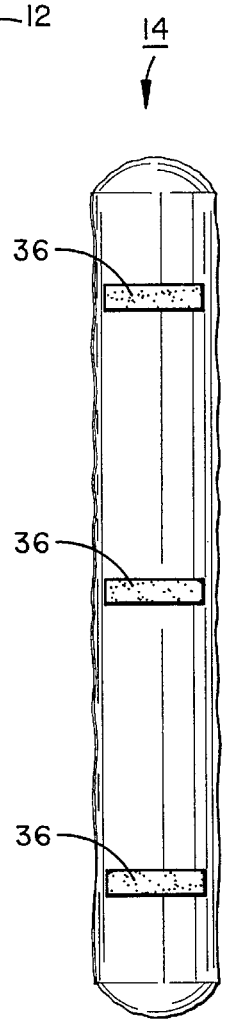
FIG. 4 is a bottom plan view of the back support of the present invention.
Figure 5:
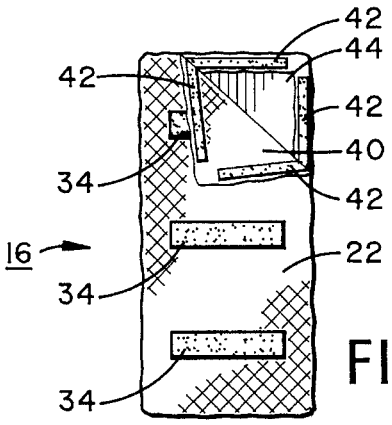
FIG. 5 is a bottom plan view of the abdominal support of the present invention showing the method of attachment of covering the abdominal support of the present invention.

Referring also to FIGS. 3–5, three, spaced apart, parallel hook and loop fastener strips 30 are attached to base pad 12 in the desired location for abdominal support 16 (FIG. 1) and three, hook and loop fastener strips 32 are attached to the base pad in the desired location for back support 14. Hook and loop fastener strips 32 are substantially longer than the projected width of back support 14. Attached to the bottom surface of abdominal support 16 are three, spaced apart, parallel hook and loop fastener strips 34 (FIG. 5) having the same spacing as hook and loop fastener strips 30 (FIG. 3) for the releasable attachment to base pad 12 by means of the mutual engagement of hook and loop fastener strips 30 and 34 (FIG. 2). Attached to the bottom surface of back support 14 are three, spaced apart, parallel hook and loop fastener strips 36 (FIG. 4) having the same spacing as hook and loop fastener strips 32 (FIG. 1) for the releasable attachment to base pad 12 by means of the mutual engagement of hook and loop fastener strips 32 and 36 (FIG. 2).

It can be seen on FIG. 2 that hook and loop fastener strips 32 are considerably longer than hook and loop fastener strips 36. This feature permits the positive fastening of back support 14 on base pad 12 at a selected distance "D" (FIGS. 1 and 2) from abdominal support 16 to accommodate infants of different sizes.

Referring to FIG. 5, a covering material 40 wraps abdominal support 16 and is releasably secured in place by means of mutually engageable hook and loop fastener strips 42.

Figure 6:
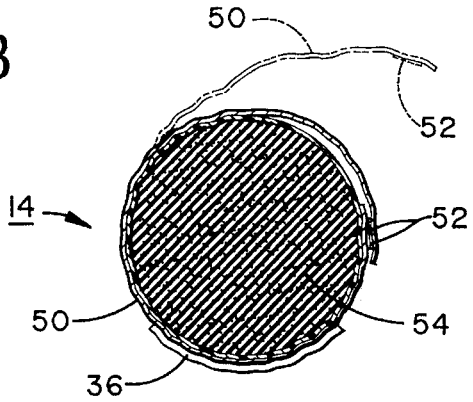
FIG. 6 is an end elevational view, in cross-section, of the back support showing the method of covering the back support of the present invention.

Referring to FIG. 6, a covering material 50 wraps back support 14 and is releasably secured in place by means of mutually engageable hook and loop fastener strips 52.

Covering materials 40 and 50 have waterproof outer surfaces to protect the back support core 54 of back support 14 and the abdominal support core 44 of abdominal support 16 and may be easily removed for laundering (FIGS. 5 and 6). The back support core 54 and abdominal support core 44 are formed from a firm foam material (FIG. 6). Alternatively, the core material may be straw or feathers or any other suitable stuffing.

Figure 7:
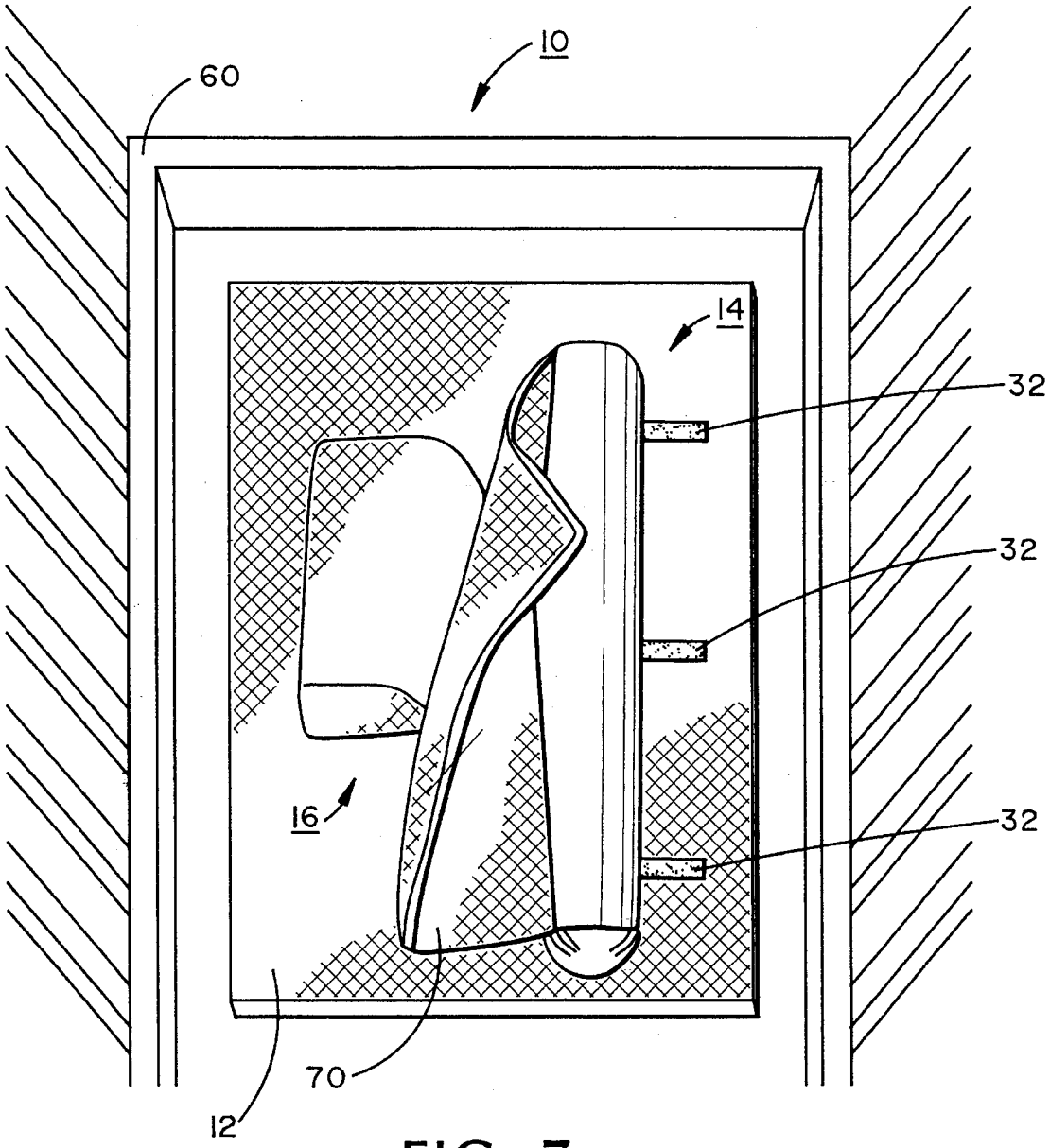
FIG. 7 is a top plan view showing a quilt attached to the back support and showing the infant support in a baby crib.

FIG. 7 illustrates the infant support 10 placed in a baby crib 60, but the infant support 10 may also be placed on other types of beds or even on a floor or other flat surface (not shown). As shown on FIG. 7, back support 14 may include an outer quilt covering 70 attached to back support 14 by hook and loop fastener (not shown) for blanketing an infant.

Preferably, all hook and loop fasteners are of, or similar to, the type of hook and loop fasteners commercially available under the trademark "VELCRO."

Base pad 12 preferably has a rectangular shape and is approximately 22 inches wide by 32 inches long. Back support 14 is preferably about 3 to 4 inches in diameter and about 18 to 20 inches long. Abdominal support 16 is preferably about 4 to 5 inches high and 4 to 5 inches wide, exclusive of sloped surface 18, and should be positioned with the lower end of sloped surface 18 facing back support 14 to fit under the infant's abdomen while the infant is lying on it side on base pad 12 and the front of the infant's body faces the abdominanl support 16. The infant's head is spaced apart from the abdominal support 16. The back support 14 is then adjustably positioned to make contact with the infant's back while the infant is lying on its side.

It can be seen that infant support 10 is comfortable, does not restrict the arms of the infant, and permits the infant to assume the fetal position.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A support for an infant sleeping on one side, said support comprising:

(a) a base member;

(b) a back support, releasably attached to said base member, said back support to engage the back of said infant, comprising a substantially right circular cylindrical form;

(c) an abdominal support, releasably attached to said base member, said abdominal support to engage the abdomen of said infant, comprising:

a substantially flat upper surface;

a substantially flat lower surface, said lower surface having a transverse dimension greater than the transverse dimension of the upper surface;

a supporting side surface sloping downwardly and inwardly from the upper surface to the lower surface, said supporting side surface for placement adjacent an abdomen of said infant, said supporting side surface further spaced apart from a head of said infant;

an outer side surface disposed substantially vertically, and disposed opposite said supporting side surface; and said abdominal support is about one-half the length of said back support;

(d) an adjustment means, for selectively positioning apart said back support and said abdominal support so as to accommodate therebetween infants of different sizes, comprising:

a plurality of spaced apart back support hook and loop fastener strips attached to a lower surface of said back support;

a plurality of spaced apart abdomen support hook and loop fastener strips attached to a lower surface of said abdomen support;

a first plurality of spaced apart base member hook and loop fastener strips, attached to an upper surface of said base member and corresponding to said plurality of abdomen support hook and loop fastener strips, said abdominal support being releasably attachable to a fixed position on said base member;

a second plurality of spaced apart base member hook and loop fastener strips, attached to an upper surface of said base member and corresponding to said plurality of back support hook and loop fastener strips, said second plurality of spaced apart base member hook and loop fastener strips being substantially longer than said back support hook and loop fastener strips, said back support being positionable at a selected distance from said abdominal support by the mutual engagement of said back support hook and loop fastener strips at a selected position along said base member hook and loop fastener strips;

said plurality of spaced apart back support hook and loop fastener strips are fixedly attached said back support perpendicularly to a longitudinal dimension of said back support; said plurality of spaced apart abdomen support hook and loop fastener strips are fixedly attached to said base member perpendicularly to a longitudinal dimension of said abdomen support;

said first plurality of spaced apart base member hook and loop fastener strips are fixedly attached to said base member perpendicularly to a longitudinal dimension of said base member; and said second plurality of spaced apart base member hook and loop fastener strips are fixedly attached to said base member perpendicularly to a longitudinal dimension of said base member.

2. A support, as defined in claim 1, further comprising:

(a) a waterproof covering wrapped around said abdominal support and secured in place by means of hook and loop fastener strips; and (b) a waterproof covering wrapped around said back support and secured in place by means of hook and loop fastener strips.

* * * * *